US009655194B2

(12) United States Patent
Kumada et al.

(10) Patent No.: US 9,655,194 B2
(45) Date of Patent: May 16, 2017

(54) LIGHTING CONTROL DEVICE, LIGHTING DEVICE, AND LIGHTING FIXTURE

(71) Applicant: Panasonic Intellectual Property Management Co., Ltd., Osaka (JP)

(72) Inventors: Kazuhiro Kumada, Hyogo (JP); Koji Uenoyama, Kyoto (JP); Miyo Kangyo, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/741,845

(22) Filed: Jun. 17, 2015

(65) Prior Publication Data

US 2015/0382411 A1 Dec. 31, 2015

(30) Foreign Application Priority Data

Jun. 25, 2014 (JP) ..... 2014-130528

(51) Int. Cl.
*H05B 33/08* (2006.01)

(52) U.S. Cl.
CPC ..... *H05B 33/086* (2013.01); *H05B 33/0818* (2013.01)

(58) Field of Classification Search
CPC .. H05B 33/08; H05B 33/086; H05B 33/0815; H05B 33/0818; H05B 33/0857; H05B 37/02
USPC ..... 315/210, 224, 250, 291, 297, 308, 312
See application file for complete search history.

(56) References Cited

U.S. PATENT DOCUMENTS

2010/0007292 A1* 1/2010 Horino ..... H05B 37/029 315/312
2010/0225241 A1* 9/2010 Maehara ..... H05B 33/0863 315/250
2012/0153841 A1 6/2012 Tomiyama et al.
2013/0113394 A1* 5/2013 Ido ..... H05B 33/086 315/297
2013/0293134 A1 11/2013 Ishikita et al.
2015/0084534 A1* 3/2015 Fukuda ..... H05B 33/086 315/210

FOREIGN PATENT DOCUMENTS

JP 2011-009078 A 1/2011
JP 2012-133995 A 7/2012
(Continued)

*Primary Examiner* — Thai Pham
(74) *Attorney, Agent, or Firm* — Renner, Otto, Boisselle & Sklar, LLP

(57) ABSTRACT

The lighting control device according to the present invention includes: a power supply for operating a light source including a first light source and a second light source lower in color temperature than the first light source; and a controller for controlling the power supply. The power supply includes: a first power supply for supplying power in a first range to the first light source; and a second power supply for supplying power in a second range to the second light source. The controller controls the first and second power supplies to adjust power supplied to the first light source and power supplied to the second light source so that a color temperature of the light source is equal to a color temperature which is selected from a predetermined color adjustment range as a desired value. The first range is lower in a lower limit than the second range.

16 Claims, 13 Drawing Sheets

(56) References Cited

FOREIGN PATENT DOCUMENTS

| | | | |
|---|---|---|---|
| JP | 2013-098037 | A | 5/2013 |
| JP | 2013-101818 | A | 5/2013 |
| WO | WO 2012/063815 | A1 | 5/2012 |

* cited by examiner

LIGHTING CONTROL DEVICE, LIGHTING DEVICE, AND LIGHTING FIXTURE

CROSS-REFERENCE TO RELATED APPLICATIONS

The application is based upon and claims the benefit of priority of Japanese Patent Application No. 2014-130528, filed on Jun. 25, 2014, the entire contents of which are incorporated herein by reference.

TECHNICAL FIELD

The present invention relates to lighting control devices, lighting devices, and lighting fixtures, and in particular relates to a lighting control device, a lighting device, and a lighting fixture which are capable of adjusting luminance of lighting and color of lighting.

BACKGROUND ART

Document 1 (JP 2011-9078 A) discloses a conventional example of lighting devices. This conventional example includes a lighting source, a power supply circuit, and a dimming controller, and the lighting source is constituted by three types of light emitting diodes. The three types of light emitting diodes have different color temperatures.

The dimming controller includes three output adjusters. Each of the three output adjusters is configured to adjust a light output of a corresponding one type of light emitting diodes.

In the conventional example disclosed in document 1, a ratio of outputs of the light emitting diodes is adjusted by use of the three output adjusters, and thereby a color temperature of light emitted from the lighting source (i.e., color of lighting) is changed in accordance with a blackbody locus.

By the way, to realize adjustment of color of lighting (light color), at least two light sources with different light colors and at least two power supplies for individual light sources are necessary. For example, it is considered that even a simplest structure of such a lighting device requires a light source for emitting light with a relatively high color temperature (high color temperature light source), a light source for emitting light with a relatively low color temperature (low color temperature light source), a power supply for the high color temperature light source, and a power supply for the low color temperature light source.

In this regard, when a lower limit of a color adjustment range (i.e., a lowest color temperature) of the lighting device is set to a color temperature of the low color temperature light source, the power supply for the high color temperature light source is required to set an output of the high color temperature light source to zero at the lower limit of the color adjustment range. In other words, the power supply for the high color temperature light source is required to be capable of continuously changing the output of the high color temperature light source in a range of 0 to 100%. Note that, 100% means the light output at rated lighting.

While, when an upper limit of the color adjustment range (i.e., a highest color temperature) of the lighting device is set to be lower than a color temperature of the high color temperature light source, the power supply for the low color temperature light source is not required to set an output of the low color temperature light source to zero at the upper limit of the color adjustment range. In other words, it is sufficient that the power supply for the low color temperature light source can continuously change the output of the low color temperature light source in a range of X (>0) to 100%. Besides, when the power supply continuously changes the output of light source in a range of 0 to 100%, as the light output comes closer to 0%, the operation of the power supply becomes unstable and the light output becomes likely to vary (flicker).

Generally, a white LED of commercially available LEDs for lighting has a color temperature in a range of 2700 K to 6500 K. This is because specifications for the chromaticity specified by American National Standards Institute (ANSI C78.377) are often used in a field of the LEDs for lighting. The aforementioned specifications define a range of the chromaticity as a range of a color temperature of 2700 K to 6500 K.

Note that, as described above, with regard to lighting devices (lighting fixtures) providing illumination light with a desired color temperature by independently adjusting light outputs of two types of light sources (white LEDs) which are a high color temperature light source and a low color temperature light source, different color adjustments ranges are required for different intended purposes.

For example, a light color close to 5000 K is required for offices, but a light color in a range of 2700 K to 4000 K is required for eating and drinking establishments such as restaurants. Therefore, to satisfy requirements for different intended purposes, the lighting device is required to be capable of adjusting a color temperature in a range of 2700 K to 5000 K. To realize lighting at the upper limit (5000 K) of the color adjustment range, it is sufficient to mix light with 6500 K from the high color temperature light source and light with 2700 K from the low color temperature light source at a predetermined ratio. In contrast, to realize lighting at the lower limit (2700 K) of the color adjustment range, it is sufficient to use only light with 2700 K from the low color temperature light source. Hence, as described above, the power supply for the high color temperature light source (6500 K) is required to be capable of continuously changing the output of the high color temperature light source in a range of 0 to 100%. Note that, when the low color temperature light source is a light source (white LED) with a color temperature lower than 2700 K, it is sufficient that the power supply for the high color temperature light source is capable of continuously changing the output of the high color temperature light source in a range of X (>0) to 100%. However, such light sources (white LED) with a color temperature lower than 2700 K are not specified by the aforementioned specifications, and are very expensive because of the low demand for them, and are much less frequently used.

SUMMARY OF INVENTION

In view of the above insufficiency, the present invention has aimed to suppress a variation in a light output and nevertheless expand a color adjustment range.

The lighting control device of the first aspect in accordance with the present invention includes: a power supply configured to operate a light source including a first light source and a second light source lower in color temperature than the first light source; and a controller configured to control the power supply. The power supply includes: a first power supply configured to supply electric power in a first range to the first light source; and a second power supply configured to supply electric power in a second range to the second light source. The controller is configured to control the first power supply and the second power supply to adjust the electric power supplied to the first light source and the electric power supplied to the second light source so that a color temperature of the light source is equal to a color temperature which is selected from a predetermined color adjustment range as a desired value. The first range is lower in a lower limit than the second range.

The lighting control device of the second aspect in accordance with the present invention includes: a power supply configured to operate a light source including a first light source and a second light source lower in color temperature than the first light source; and a controller configured to control the power supply. The power supply includes: a first power supply configured to adjust a light output of the first light source in a first range; and a second power supply configured to adjust a light output of the second light source in a second range. The controller is configured to control the first power supply and the second power supply to adjust the light output of the first light source and the light output of the second light source so that a color temperature of the light source is equal to a color temperature which is selected from a predetermined color adjustment range as a desired value. The first range is lower in a lower limit than the second range.

The lighting device of one aspect in accordance with the present invention includes: a light source including a first light source and a second light source lower in color temperature than the first light source; and the lighting control device according to the first or second aspect.

The lighting fixture of one aspect in accordance with the present invention includes: a light source including a first light source and a second light source lower in color temperature than the first light source; and the lighting control device according to the first or second aspect, and a fixture body for supporting the light source.

BRIEF DESCRIPTION OF THE DRAWINGS

The figures depict one or more implementation in accordance with the present teaching, by way of example only, not by way of limitations. In the figures, like reference numerals refer to the same or similar elements.

DESCRIPTION OF EMBODIMENTS

Embodiment 1

The lighting device 4 including the lighting control device 1 of Embodiment 1 in accordance with the present invention is described in detail with reference to FIG. 1 to FIG. 4.

Figure 1:
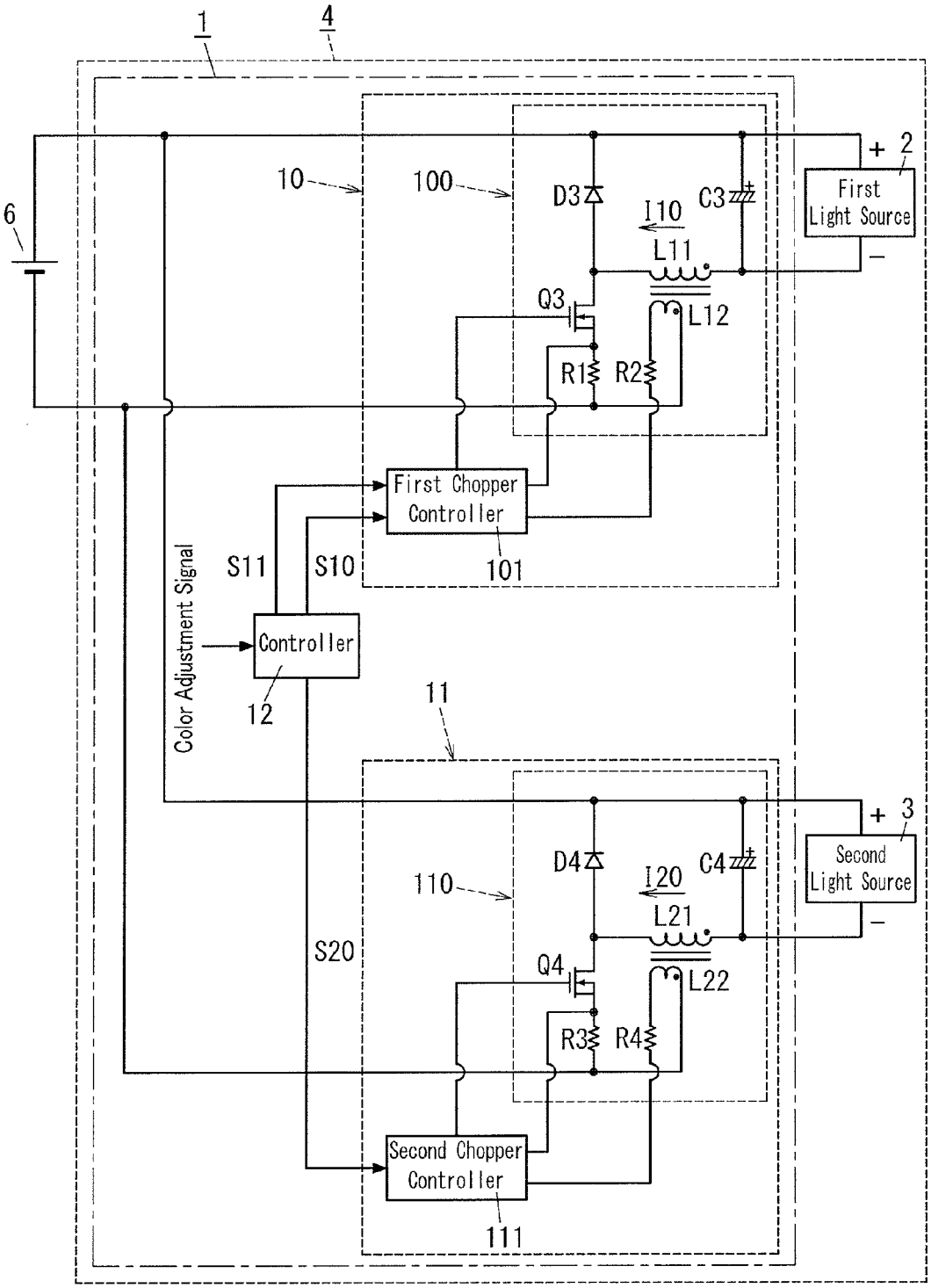
FIG. 1 is a diagram illustrating a configuration of a circuit of the lighting device including the lighting control device of Embodiment 1 in accordance with the present invention.

As shown in FIG. 1, the lighting device 4 includes the lighting control device 1, a first light source 2, and a second light source 3, and is configured to operate the first light source 2 and the second light source 3 with DC power supplied from a DC power source 6. Note that, the DC power source 6 may be constituted by an AC power source and a power conversion circuit for converting AC power into DC power. When the DC power source 6 is constituted by the AC power source and the power conversion circuit, this power conversion circuit may be included in the lighting control device 1 or the lighting device 4.

The first light source 2 includes one or more light emitting diodes and is configured to emit light with a relatively high color temperature (for example, 6500 K). The second light source 3 includes one or more light emitting diodes and is configured to emit light with a color temperature (for example, 2700 K) lower than the color temperature of the first light source 2. Note that, the above values of the color temperatures (6500 K and 2700 K) are merely examples, and the color temperatures of the first and second light sources 2 and 3 are not limited to the above values.

The first light source 2 and the second light source 3 constitute a single light source. This light source emits light containing at least one of light from the first light source 2 and light from the second light source 3 (i.e., only light from the first light source 2, only light from the second light source 3, or both light from the first light source 2 and light from the second light source 3).

The lighting control device 1 includes a first power supply 10 for operating the first light source 2, a second power supply 11 for operating the second light source 3, and a controller 12 for controlling the first power supply 10 and the second power supply 11. The first power supply 10 and the second power supply 11 constitute a power supply configured to operate the light source including the first light source 2 and the second light source 3 lower in color temperature than the first light source 2.

The first power supply 10 is configured to supply electric power in a first range (first power range) to the first light source 2. The light output of the first light source 2 depends on electric power supplied to the first light source 2. In other words, the first power supply 10 is configured to adjust the light output of the first light source 2 in a first range (first dimming range).

The first power supply 10 includes a first step-down chopper circuit 100 and a first chopper controller 101. The second power supply 11 includes a second step-down chopper circuit 110 and a second chopper controller 111.

The first step-down chopper circuit 100 is constituted by a switch device Q3, a diode D3, inductors L11 and L12, a capacitor C3, and resistors R1 and R2, for example. The switch device Q3 is an n-channel type field-effect transistor.

A drain of the switch device Q3 is connected to an anode of the diode D3, and a source of the switch device Q3 is connected to a negative electrode of the DC power source 6 via the resistor R1. The capacitor C3 is an electrolytic capacitor, and a higher potential side terminal thereof is connected to a cathode of the diode D3 and a positive electrode of the DC power source 6, and a lower potential side terminal thereof is connected to a first end of the inductor L11. A second end of the inductor L11 is connected to the anode of the diode D3. Further, the inductor L12 is magnetically coupled with the inductor L11 to form a transformer. A first end of the inductor L12 is connected to the negative electrode of the DC power source 6, and a second end of the inductor L12 is connected to the first chopper controller 101 through the resistor R2. Note that, the first light source 2 is connected between the both terminals of the capacitor C3.

The first chopper controller 101 measures a drain current of the switch device Q3 based on a voltage across the resistor R1. Further, the first chopper controller 101 measures a voltage induced in the inductor L12 by use of the resistor R2. Moreover, the first chopper controller 101 outputs a drive signal to a gate of the switch device Q3 to perform switching control on the switch device Q3.

After turning on the switch device Q3, the first chopper controller 101 turns off the switch device Q3 when a value of the drain current of the switch device Q3 reaches a predetermined peak value. The first step-down chopper circuit 100 causes the inductor L11 to store energy during an on-period of the switch device Q3, and causes the inductor L11 to discharge stored energy during an off-period of the switch device Q3. The energy discharged from the inductor L11 is supplied to the capacitor C3 through the diode D3 in the form of a regenerative current. The capacitor C3 is charged with the regenerative current. Further, while the regenerative current flows through the inductor L11, an induction voltage occurs in the inductor L12. When a value of the induction voltage of the inductor L12 falls below a predetermined value, the first chopper controller 101 turns on the switch device Q3 again. The first chopper controller 101 performs switching control on the switch device Q3 in the above manner, and thereby decreases a DC voltage inputted from the DC power source 6 down to a DC voltage required by the first light source 2.

In brief, the first power supply 10 can perform peak value adjusting control (control in a DC dimming manner) of adjusting a peak value of a current supplied to the first light source 2 and duty cycle adjusting control (control in a burst dimming manner) of adjusting a duty cycle of the current supplied to the first light source 2.

The second power supply 11 is configured to supply electric power in a second range (second power range) to the second light source 3. The light output of the second light source 3 depends on electric power supplied to the second light source 3. In other words, the second power supply 11 is configured to adjust the light output of the second light source 3 in a second range (second dimming range).

The second power supply 11 includes a second step-down chopper circuit 110 and a second chopper controller 111.

The second step-down chopper circuit 110 is constituted by a switch device Q4, a diode D4, inductors L21 and L22, a capacitor C4, and resistors R3 and R4, for example. The switch device Q4 is an n-channel type field-effect transistor. A drain of the switch device Q4 is connected to an anode of the diode D4, and a source of the switch device Q4 is connected to the negative electrode of the DC power source 6 via the resistor R3. The capacitor C4 is an electrolytic capacitor, and a higher potential side terminal thereof is connected to a cathode of the diode D4 and the positive electrode of the DC power source 6, and a lower potential side terminal thereof is connected to a first end of the inductor L21. A second end of the inductor L21 is connected to the anode of the diode D4. Further, the inductor L22 is magnetically coupled with the inductor L21 to form a transformer. A first end of the inductor L22 is connected to the negative electrode of the DC power source 6, and a second end of the inductor L22 is connected to the second chopper controller 111 through the resistor R4. Note that, the second light source 3 is connected between the both terminals of the capacitor C4.

The second chopper controller 111 measures a drain current of the switch device Q4 based on a voltage across the resistor R3. Further, the second chopper controller 111 measures a voltage induced in the inductor L22 by use of the resistor R4. Moreover, the second chopper controller 111 outputs a drive signal to a gate of the switch device Q4 to perform switching control on the switch device Q4.

After turning on the switch device Q4, the second chopper controller 111 turns off the switch device Q4 when a value of the drain current of the switch device Q4 reaches a predetermined peak value. The second step-down chopper circuit 110 causes the inductor L21 to store energy during an on-period of the switch device Q4, and causes the inductor L21 to discharge stored energy during an off-period of the switch device Q4. The energy discharged from the inductor L21 is supplied to the capacitor C4 through the diode D4 in the form of a regenerative current. The capacitor C4 is charged with the regenerative current. Further, while the regenerative current flows through the inductor L21, an induction voltage occurs in the inductor L22. When a value of the induction voltage of the inductor L22 falls below a predetermined value, the second chopper controller 111 turns on the switch device Q4 again. The second chopper controller 111 performs switching control on the switch device Q4 in the above manner, and thereby decreases a DC voltage inputted from the DC power source 6 down to a DC voltage required by the second light source 3.

In brief, the second power supply 11 can perform peak value adjusting control (control in the DC dimming manner) of adjusting a peak value of a current supplied to the second light source 3 and duty cycle adjusting control (control in the burst dimming manner) of adjusting a duty cycle of the current supplied to the second light source 3.

Note that, each of the first chopper controller 101 and the second chopper controller 111 may be preferably realized by use of a commercially-available integrated circuit for step-down control or a commercially-available driver IC for LED lighting.

Note that, with regard to the first chopper controller 101 and the second chopper controller 111, a control mode in which a prescribed value to be compared with an induction voltage of the inductor L12, L22 is zero (or a value substantially regarded as zero) is called a critical current mode. Further, a control mode in which the prescribed value is larger than zero is called a continuous current mode. Additionally, a control mode in which the prescribed value is zero and the switch device Q3, Q4 is turned on after a lapse of predetermined time from the time when the induction voltage (regenerative current) becomes zero is called a discontinuous current mode. These three types of control modes (the critical current mode, the continuous current mode, and the discontinuous current mode) are well known and therefore detailed explanations thereof are omitted.

The controller 12 is configured to control a power supply (the first power supply 10 and the second power supply 11). In more detail, the controller 12 is configured to control the first power supply 10 and the second power supply 11 to adjust the electric power supplied to the first light source 2 and the electric power supplied to the second light source 3 so that a color temperature of the light source is equal to a color temperature which is selected from a predetermined color adjustment range as a desired value (desired color temperature). In other words, the controller 12 is configured to control the first power supply 10 and the second power supply 11 to adjust the light output of the first light source 2 and the light output of the second light source 3 so that a color temperature of the light source is equal to a color temperature which is selected from a predetermined color adjustment range as a desired value (desired color temperature).

The controller 12 is configured to cause the first power supply 10 to perform different control in accordance with the electric power supplied to the first light source 2 (the light output of the first light source 2).

The controller 12 is configured to, when the electric power supplied to the first light source 2 (the light output of the first light source 2) is included in a first section of the first range, cause the first power supply 10 to perform the duty cycle adjusting control (control in the burst dimming manner). The controller 12 is configured to, when the electric power supplied to the first light source 2 (the light output of the first light source 2) is included in a second section of the first range, cause the first power supply 10 to perform both the peak value adjusting control and the duty cycle adjusting control.

The first section is, for example, defined as a section between an upper limit of the first range and a predetermined value which is smaller than the upper limit but is larger than a lower limit of the first range. The second section is defined as a section between the predetermined value and the lower limit of the first range. For example, the predetermined value is defined as a value (equal to or more than several %) corresponding to the dimming level sufficiently larger than zero.

The controller 12 is configured to cause the second power supply 11 to perform the duty cycle adjusting control (control in the burst dimming manner).

Figure 2:
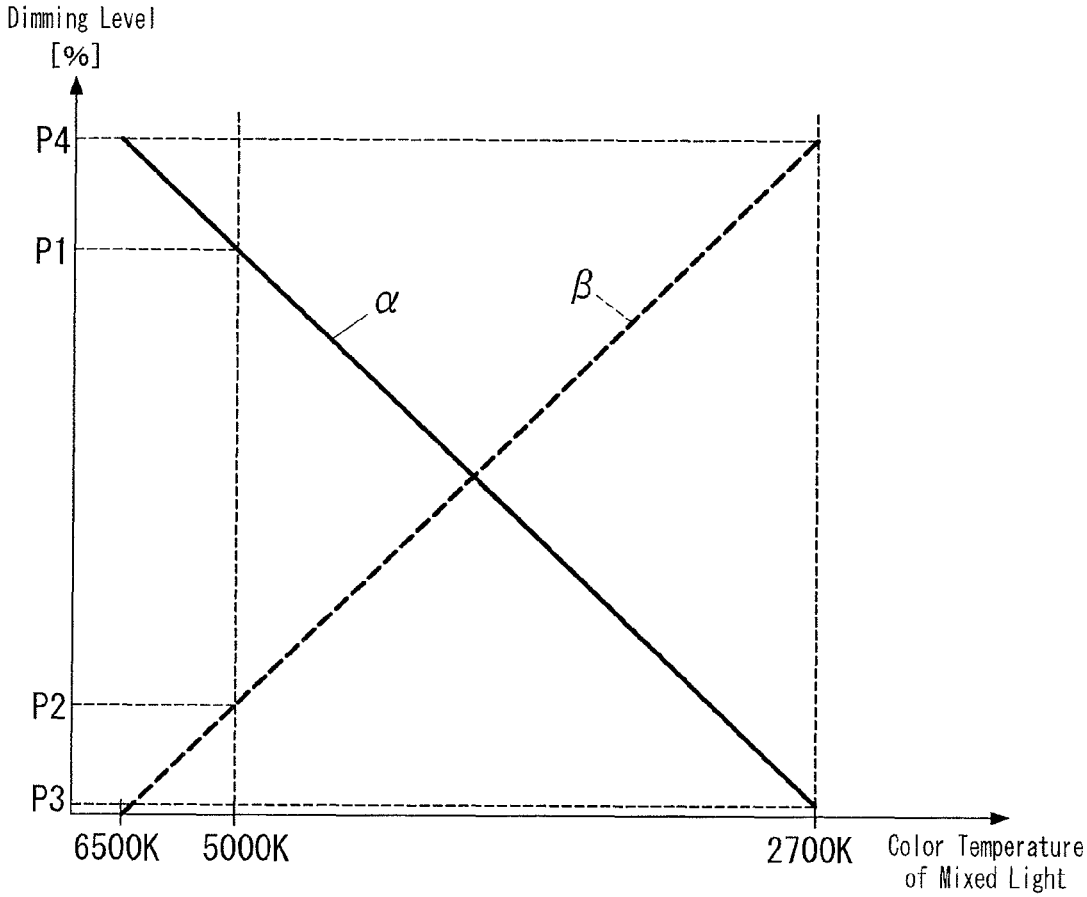
FIG. 2 is an explanatory diagram illustrating operation of the lighting control device of Embodiment 1.

The controller 12 is realized by use of a microcontroller, for example. The controller 12 obtains a desired value of the color temperature (desired color temperature) from a color adjustment signal inputted from an external device, and determines dimming levels for the light sources 2 and 3 (the power supplies 10 and 11) based on a correspondence relation shown in FIG. 2. Note that, the horizontal axis in FIG. 2 represents a color temperature of light which is a mixture of light from the first light source 2 (indicated by a solid line $\alpha$ in FIG. 2) and light from the second light source 3 (indicated by a broken line $\beta$ in FIG. 2). Further, the vertical axis in FIG. 2 represents a dimming level of each of the first light source 2 and the second light source 3. The dimming level of the light source 2 is represented by a percentage of the current light output to the light output observed when the rated current flows through the light source 2. The dimming level of the light source 3 is represented by a percentage of the current light output to the light output observed when the rated current flows through the light source 3.

Note that, there are two types of dimming manners for a light emitting diode (LED). One of them is a dimming manner of changing the magnitude of the current continuously flowing through the LED, and is normally called a DC dimming manner. The other is a dimming manner of periodically starting and ending power supply to the LED to change a ratio of a power supply period to a whole (duty cycle), and is normally called a burst dimming manner.

In the burst dimming manner, flicker may be caused by interference with a video device such as a video camera. The interference causing the flicker may result from a difference between the period of burst dimming and a shutter speed of the video device (exposure time), and the flicker may appear on an image displayed by the video device, as blinking (fluctuations in brightness) or fringe pattern change in brightness. Note that, according to Technical Requirements under the Electrical Appliances and Materials Safety Act for LEDs, it is required that a frequency for repeat of light output is equal to or more than 500 Hz (see Article 1 of Ministerial Ordinance Specifying Technical Requirements for Electrical Appliances and Materials).

In the DC dimming manner, generally, the peak value of the current flowing through the switch element of the step-down chopper circuit is increased or decreased and the switch element is controlled in the critical current mode. However, in the DC dimming manner, there is a limit (lower limit) of the on-period (on-width) of the drive signal given to the switch element, and therefore this leads to a problem that it is difficult to perform deep dimming (lighting at a lower dimming level) relative to the burst dimming manner.

In the lighting control device 1 and the lighting device 4 of the present embodiment, the controller 12 controls the second power supply 11 in only the burst dimming manner, and controls the first power supply 10 in a manner which is a combination of the burst dimming manner and the DC dimming manner. Note that, the color adjustment range in the lighting control device 1 and the lighting device 4 of the present embodiment is a range of the color temperature from 2700 K to 5000 K. In other words, the upper limit of the color adjustment range is 5000 K, and the lower limit of the color adjustment range is 2700 K. The color temperature of the first light source 2 is 6500 K, and therefore is higher than the upper limit of the color adjustment range. The color temperature of the second light source 3 is 2700 K, and is equal to the lower limit of the color adjustment range.

For example, when the desired color temperature indicated by the color adjustment signal is equal to the upper limit (5000 K) of the color adjustment range, the controller 12 determines the dimming level of the first light source 2 as P1, and determines the dimming level of the second light source 3 as P2, based on the correspondence relation shown in FIG. 2. The controller 12 converts the dimming levels P1 and P2 into duty cycles (TA1/T and TB1/T) of the burst dimming control, and outputs a signal (burst dimming signal) S10 indicative of the duty cycle (TA1/T) corresponding to the dimming level P1 and a signal (burst dimming signal) S20 indicative of the duty cycle (TB1/T) corresponding to the dimming level P2 to the first power supply 10 and the second power supply 11, respectively.

Figure 3:
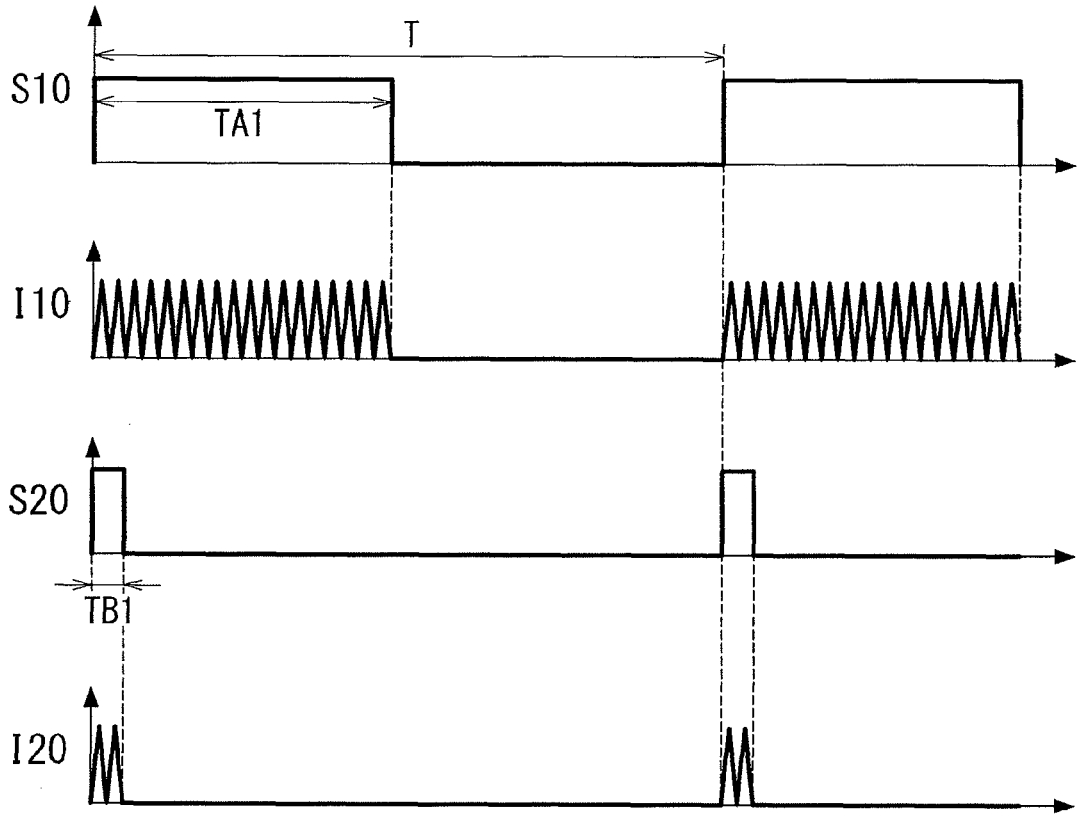
FIG. 3 is a time chart illustrating operation of the lighting control device of Embodiment 1.

When receiving the burst dimming signal S10 from the controller 12, the first chopper controller 101 performs burst dimming control on the first step-down chopper circuit 100 at the duty cycle (TA1/T) indicated by the burst dimming signal S10 (see FIG. 3). Note that, in FIG. 3, I10 represents a current (inductor current) which flows through the inductor L11 of the first step-down chopper circuit 100.

When receiving the burst dimming signal S20 from the controller 12, the second chopper controller 111 performs burst dimming control on the second step-down chopper circuit 110 at the duty cycle (TB1/T) indicated by the burst dimming signal S20 (see FIG. 3). Note that, in FIG. 3, 120 represents a current (inductor current) which flows through the inductor L21 of the second step-down chopper circuit 110.

As a result, the color temperature of light which is a mixture of light from the first light source 2 lit by the first power supply 10 and light from the second light source 3 lit by the second power supply 11 is equal to the desired color temperature (5000 K) indicated by the color adjustment signal.

In contrast, when the desired color temperature indicated by the color adjustment signal is equal to the lower limit (2700 K) of the color adjustment range, the controller 12 determines the dimming level of the first light source 2 as P3, and determines the dimming level of the second light source 3 as P4, based on the correspondence relation shown in FIG. 2. The controller 12 converts the dimming levels P3 and P4 into duty cycles (TA2/T and TB2/T) of the burst dimming control, and outputs the signal (burst dimming signal) S10 indicative of the duty cycle (TA2/T) corresponding to the dimming level P3 and the signal (burst dimming signal) S20 indicative of the duty cycle (TB2/T) corresponding to the dimming level P4 to the first power supply 10 and the second power supply 11, respectively. Additionally, the controller 12 determines a desired peak value of the DC dimming control corresponding to the dimming level P3, and outputs a signal (DC dimming signal) S11 indicative of the desired peak value to the first power supply 10.

Figure 4:
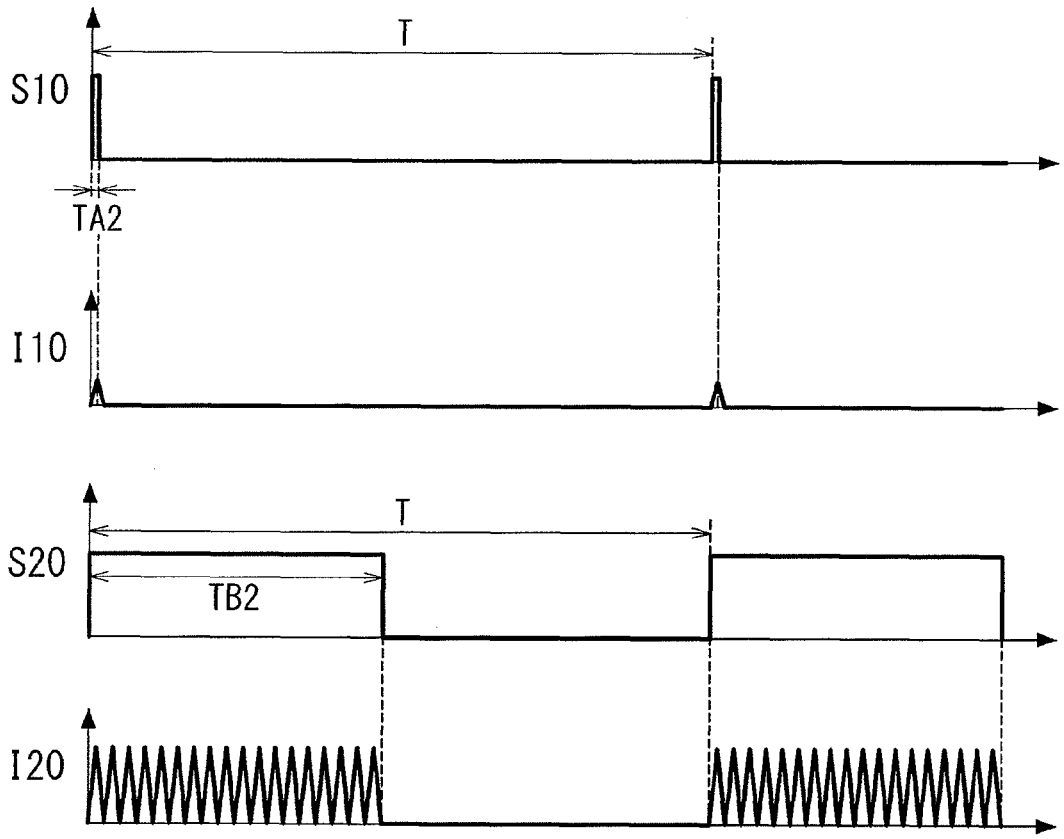
FIG. 4 is a time chart illustrating operation of the lighting control device of Embodiment 1.

When receiving the burst dimming signal S20 from the controller 12, the second chopper controller 111 performs burst dimming control on the second step-down chopper circuit 110 at the duty cycle (TB2/T) indicated by the burst dimming signal S20 (see FIG. 4). Note that, in FIG. 4, 120 represents an inductor current of the second step-down chopper circuit 110.

In contrast, when receiving the burst dimming signal S10 from the controller 12, the first chopper controller 101 performs burst dimming control on the first step-down chopper circuit 100 at the duty cycle (TA2/T) indicated by the burst dimming signal S10 (see FIG. 4). Note that, in FIG. 4, I10 represents an inductor current of the first step-down chopper circuit 100.

Additionally, the first chopper controller 101 adjusts the peak value determining the on-period (on-width) of the switch device Q3 to the desired peak value indicated by the DC dimming signal S11. Consequently, the inductor current I10 of the first step-down chopper circuit 100 decreases (see FIG. 4).

As a result, the color temperature of light which is a mixture of light from the first light source 2 lit by the first power supply 10 and light from the second light source 3 lit by the second power supply 11 is equal to the desired color temperature (2700 K) indicated by the color adjustment signal.

Note that, the dimming level P3 corresponds to the lower limit of the dimmable range of the first power supply 10, and is preferably equal to or less than 1%, for example. To achieve lighting at such an extremely low dimming level, the first chopper controller 101 performs dimming control on the first step-down chopper circuit 100 in a manner which is a combination of the burst dimming manner and the DC dimming manner.

As described above, when the lower limit of the color adjustment range of the mixed light is equal to the color temperature (2700 K) of the lower color temperature light source (the second light source 3), it is required that the lower limit of the dimming range (the first dimming range) of the higher color temperature light source (the first light source 2) is zero (or a value substantially regarded as zero). In contrast, when the upper limit of the color adjustment range is equal to a value (5000 K) which is lower than the color temperature (6500 K) of the higher color temperature light source (the first light source 2), the lower limit of the dimming range (the second dimming range) of the lower color temperature light source (the second light source 3) is allowed to be a value (several % to less than twenty %) sufficiently larger than zero (or a value substantially regarded as zero). Note that, the upper limit of each of the first dimming range and the second dimming range may be a value (100%) corresponding to the light output of rated lighting.

Hence, it is sufficient that the first power supply 10 is configured such that a minimum value of electric power (corresponding to the lower limit of the dimming range) supplied from the first power supply 10 is lower than a minimum value of electric power supplied from the second power supply 11. In other words, it is sufficient that the lower limit of the first range (the first power range) of the first power supply 10 is lower than the lower limit of the second range (the second power range) of the second power supply 11. Alternatively, it is sufficient that the first power supply 10 is configured to be higher in dimming performance than the second power supply 11. In other words, it is sufficient that the lower limit of the first range (the first dimming range) of the first power supply 10 is lower than the lower limit of the second range (the second dimming range) of the second power supply 11. Note that, when the upper limit of each of the first dimming range and the second dimming range is a value (100%) corresponding to the light output of rated lighting, the first dimming range is wider than the second dimming range. Similarly, the first power range is wider than the second power range, too.

The first power supply 10 and the second power supply 11 are configured like above, and therefore it is possible to suppress fluctuations (flicker) in the light output and expand the color adjustment range. Note that, the phrase "the dimming performance is high" means that it is possible to perform deeper dimming (lighting at the lower dimming level).

Figure 5:
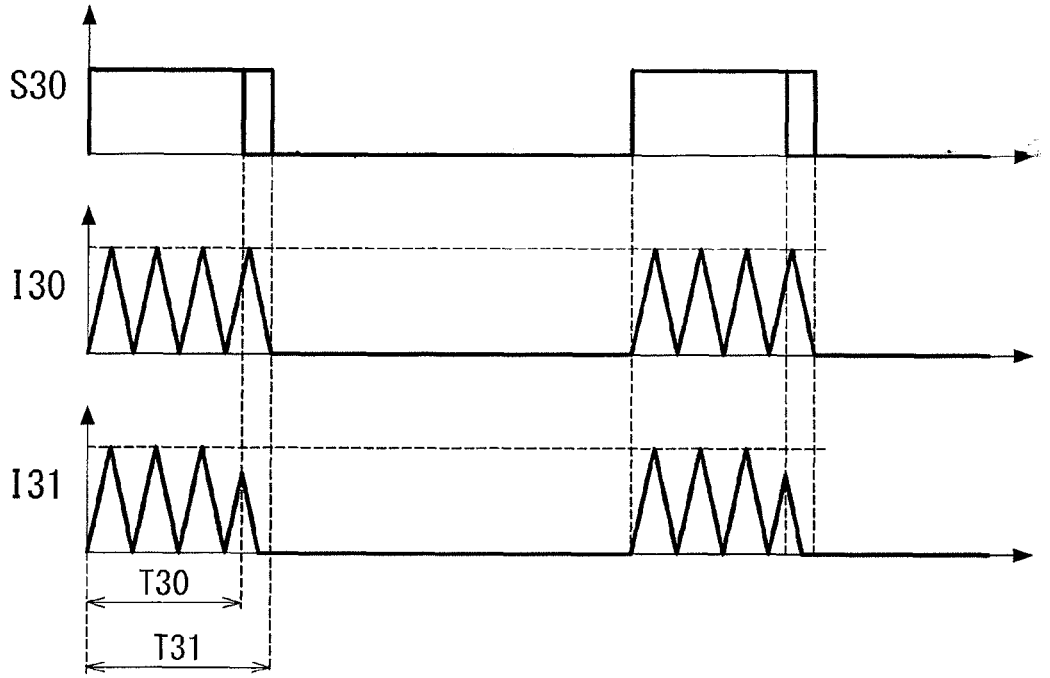
FIG. 5 is a time chart illustrating operation of the lighting control device of Embodiment 1.

Note that, in the burst dimming manner, the duty cycle decreases (the on-period shortens) as the dimming level becomes closer to the lower limit, and therefore the number of times of switching of the switch device Q3 per one on-period decreases. Further, the burst dimming signal outputted from the controller 12 may contain an error resulting from jitter of an internal clock of the controller 12 (e.g., a microcomputer constituting the controller 12). Thus, as shown in FIG. 5, the on-period of the burst dimming signal S30 may vary due to the jitter. For example, in FIG. 5, the on-period of the burst dimming signal S30 varies between T30 to T31. When the on-period of the burst dimming signal varies like this, the inductor current is likely to vary like 130 and 131. As a result, an average of the inductor current during one on-period may also vary and this leads a variation in the light output. When the dimming level is relatively high, the on-period is relatively long, and therefore a variation in the average of the inductor current resulting from a variation in the on-period is slight. In contrast, when the dimming level is close to the lower limit, the on-period is very short, and an influence of a variation in the average of the inductor current resulting from a variation in the on-period increases, and a variation in the light output can be more easily perceived.

However, in the lighting control device 1 and the lighting device 4 of the present embodiment, the lower limit of the dimming range of the second power supply 11 is a value sufficiently larger than zero. Therefore, at least the light output of the second light source 3 is unlikely to vary. Consequently, the lighting control device 1 and the lighting device 4 of the present embodiment can suppress a variation in the light output.

The lighting control device 1 of the present embodiment includes the first power supply 10 configured to operate the first light source 2 for producing light with a relatively high color temperature, the second power supply 11 configured to operate the second light source 3 for producing light with a color temperature lower than the color temperature of light produced by the first light source 2, and the controller 12 configured to control the first power supply 10 and the second power supply 11. The first power supply 10 is configured to be controlled by the controller 12 to increase and decrease electric power to be supplied to the first light source 2. The second power supply 11 is configured to be controlled by the controller 12 to increase and decrease electric power to be supplied to the second light source 3. The controller 12 is configured to control the first power supply 10 and the second power supply 11 so that the color temperature of light which is a mixture of light from the first light source 2 and light from the second light source 3 is equal to a color temperature selected as a desired value. The first power supply 10 is configured such that a minimum value of electric power supplied from the first power supply 10 is lower than a minimum value of electric power supplied from the second power supply 11. Alternatively, the first power supply 10 is configured to be higher in dimming performance than the second power supply 11.

Further, the lighting device 4 of the present embodiment includes the first light source 2, the second light source 3, and the lighting control device 1. In other words, the lighting device 4 includes a light source including the first light source 2 and the second light source 3, and the lighting control device 1.

The lighting control device 1 and the lighting device 4 of the present embodiment are configured like above, and therefore it is possible to suppress a variation in the light output and nevertheless expand the color adjustment range in contrast to a case where the minimum value of electric power supplied from the first power supply 10 is equal to the minimum value of electric power supplied from the second power supply 11, or a case where the first power supply 10 and the second power supply 11 are the same in the dimming performance.

Note that, the controller 12 of the present embodiment makes adjustment of the color temperature of mixed light (color adjustment) based on the color adjustment signal. However, the controller 12 may adjust an amount (luminous flux) of mixed light in addition to the color temperature. In more detail, the controller 12 makes adjustment of the color temperature of mixed light (color adjustment) by adjusting a ratio of the dimming level of the first power supply 10 to the dimming level of the second power supply 11, and also makes adjustment of an amount (luminous flux) of mixed light (dimming) by adjusting absolute values of the dimming levels.

Note that, it is preferable that the controller 12 perform dimming control on the first power supply 10 and the second power supply 11 in the DC dimming manner when the dimming level is a value (equal to or more than several %) sufficiently larger than zero. This is because the burst dimming manner tends to cause an increase in a variation (ripple) in a current flowing through the light source 2, 3 in contrast to the DC dimming manner.

Further, it is preferable that the controller 12 perform dimming control on the first power supply 10 in a combination of the DC dimming manner and the burst dimming manner when the lower limit of the dimming level is close to zero. Additionally, it is preferable that the controller 12 perform dimming control on the second power supply 11 in only the DC dimming manner.

In other words, the controller 12 is configured to cause the first power supply 10 to perform the peak value adjusting control (control in the DC dimming manner) in the first section, and is configured to cause the first power supply 10 to perform the peak value adjusting control and the duty cycle adjusting control in the second section. Further, the controller 12 is configured to cause the second power supply 11 to perform the peak value adjusting control.

The lighting control device 1 and the lighting device 4 are configured like above, and therefore a capacitance necessary for the capacitor C4 of the second step-down chopper circuit 110 can be reduced, and this allows use of the smaller capacitor C4. Consequently, it is possible to downsize the lighting control device 1 and the lighting device 4. Further, the second chopper controller 111 performs dimming control on the second step-down chopper circuit 110 in only the DC dimming manner, and therefore it is possible to suppress occurrence of flicker resulting from interference with a video device such as a video camera.

In the lighting control device 1 and the lighting device 4 of the present embodiment, it is preferable that the controller 12 be configured to control the second power supply 11 so as to adjust the peak value of the current to be supplied to the second light source 3. Further, in the lighting control device 1 and the lighting device 4 of the present embodiment, it is preferable that the controller 12 be configured to control the first power supply 10 so as to adjust the peak value of the current to be supplied to the first light source 2 and a period in which current is supplied to the first light source 2 intermittently.

The lighting control device 1 and the lighting device 4 of the present embodiment are configured like above, and therefore they can be downsized and capable of suppressing occurrence of flicker caused by interference with a video device such as video camera.

Embodiment 2

Figure 6:
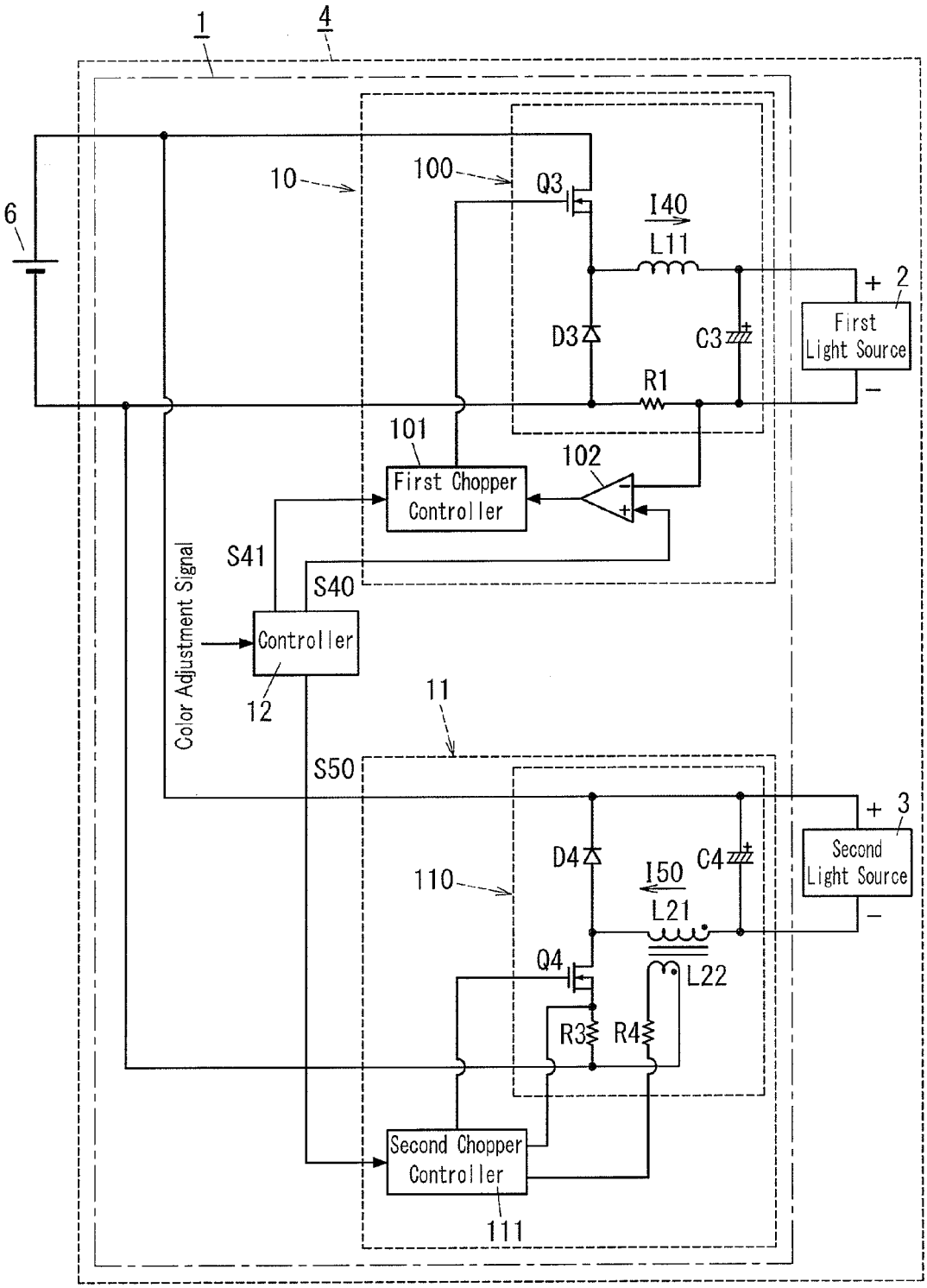
FIG. 6 is a diagram illustrating a configuration of a circuit of the lighting device including the lighting control device of Embodiment 2 in accordance with the present invention.

As shown in FIG. 6, the lighting device 4 including the lighting control device 1 of Embodiment 2 in accordance with the present invention has the same components as Embodiment 1 except the first step-down chopper circuit 100. The same components as Embodiment 1 are designated by the same reference signs as Embodiment 1 to avoid redundant description.

The first step-down chopper circuit 100 of the present embodiment is constituted by a switch device Q3, a diode D3, an inductor L11, a capacitor C3, and a resistor R1, for example. A drain of the switch device Q3 is connected to a positive electrode of a DC power source 6, and a source of the switch device Q3 is connected to a cathode of the diode D3 and a first end of the inductor L11. An anode of the diode D3 is connected to a negative electrode of the DC power source 6. A second end of the inductor L11 is connected to a higher potential side terminal of the capacitor C3. A lower potential side terminal of the capacitor C3 is connected to the negative electrode of the DC power source 6 via the resistor R1. Note that, a first light source 2 is connected between both terminals of the capacitor C3. A voltage drop corresponding to a current (inductor current) flowing through the inductor L11 may occur between both ends of the resistor R1.

Further, a first power supply 10 includes an error amplifier 102. This error amplifier 102 is mainly constituted by an operational amplifier, and thus amplifies a difference between a voltage across the resistor R1 (voltage corresponding to the inductor current) inputted to a minus terminal thereof and a DC dimming signal S40 inputted to a plus terminal thereof, and outputs the amplified difference to a first chopper controller 101.

The first chopper controller 101 is configured to control the switch device Q3 of the first step-down chopper circuit 100 in a discontinuous current mode based on the output from the error amplifier 102 and a frequency signal S41 given by a controller 12. Note that, a frequency signal S41 (see FIG. 7) is a rectangular pulse signal, and a period of this frequency signal S41 is adjusted by the controller 12.

The first chopper controller 101 adjusts (increases and decreases) an on-period (on-width) of the switch device Q3 so that the output from the error amplifier 102 is closer to zero. Further, the first chopper controller 101 turns on the switch device Q3 in synchronization with a rising edge of the frequency signal S41. Note that, the period of the frequency signal S41 is set to be longer than a sum of the on-period of the switch device Q3 and a period in which a regenerative current flows. In short, the first power supply 10 is a step-down chopper circuit operating in the discontinuous current mode.

The controller 12 is configured to perform dimming control on the first power supply 10 and a second power supply 11 in the DC dimming manner. Further, the controller 12 is configured to perform dimming control on the first power supply 10 by increasing and decreasing the frequency (period) of the frequency signal S41.

For example, when the desired color temperature indicated by the color adjustment signal is equal to the upper limit (5000 K) of the color adjustment range, the controller 12 determines the dimming level of the first light source 2 as P1, and determines the dimming level of a second light source 3 as P2, based on the correspondence relation shown in FIG. 2. The controller 12 determines desired peak values of DC dimming control corresponding to the dimming levels P1 and P2, and outputs the DC dimming signal S40 indicative of the desired peak value corresponding to the dimming level P1 and a DC dimming signal S50 (see FIG. 7) indicative of the desired peak value corresponding to the dimming level P2 to the first power supply 10 and the second power supply 11, respectively.

Figure 7:
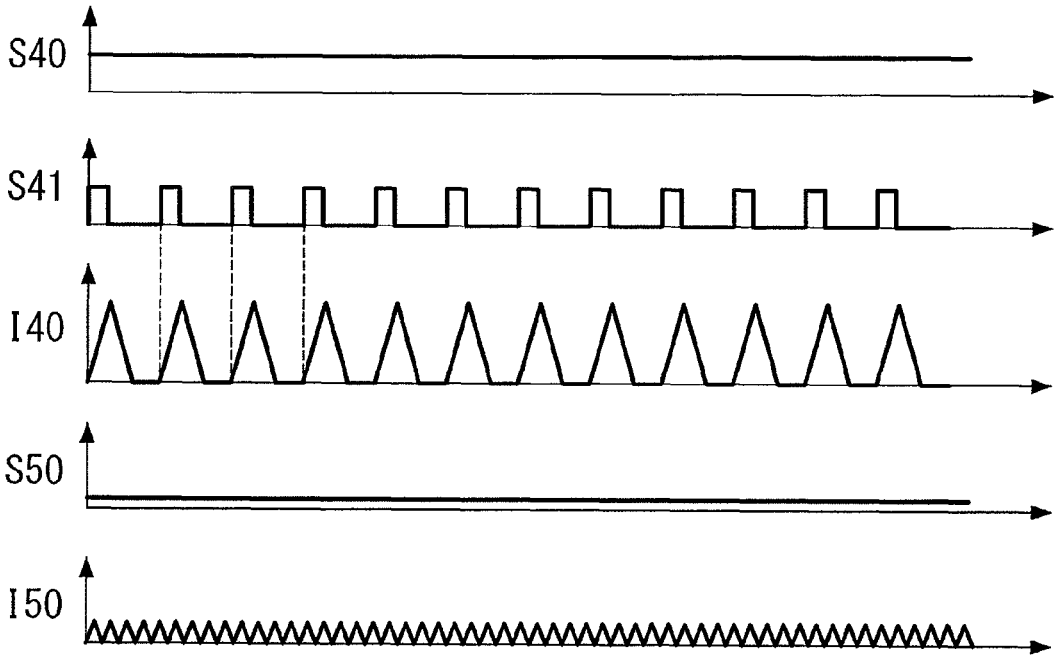
FIG. 7 is a time chart illustrating operation of the lighting control device of Embodiment 2.

A second chopper controller 111 of the second power supply 11 controls, based on the DC dimming signal S50 (see FIG. 7), a switch device Q4 of a second step-down chopper circuit 110 in the critical current mode (see FIG. 7). In FIG. 7, 150 represents a current (inductor current) which flows through the inductor L21 of the second step-down chopper circuit 110.

As described above, the second chopper controller 111 performs dimming control on the second step-down chopper circuit 110 in the DC dimming manner by adjusting the on-period of the switch device Q4 in accordance with the DC dimming signal S50. In short, the second power supply 11 is a step-down chopper circuit operating in the critical current mode.

In contrast, the first chopper controller 101 of the first power supply 10 controls the switch device Q3 of the first step-down chopper circuit 100 in the discontinuous current mode based on the DC dimming signal S40 (see FIG. 7) and the frequency signal S41 (see FIG. 7). In FIG. 7, 140 represents a current (inductor current) which flows through the inductor L11 of the first step-down chopper circuit 100.

In more detail, the first chopper controller 101 is configured to turn on the switch device Q3 in synchronization with a rising edge of the frequency signal S41 (see FIG. 7), and turn off the switch device Q3 after a lapse of the on-period corresponding to the DC dimming signal S40 from the time of turning on the switch device Q3.

As a result, the color temperature of light which is a mixture of light from the first light source 2 lit by the first power supply 10 and light from the second light source 3 lit by the second power supply 11 is equal to the desired color temperature (5000 K) indicated by the color adjustment signal.

In contrast, when the desired color temperature indicated by the color adjustment signal is equal to the lower limit (2700 K) of the color adjustment range, the controller 12 determines the dimming level of the first light source 2 as P3, and determines the dimming level of a second light source 3 as P4, based on the correspondence relation shown in FIG. 2. The controller 12 determines the desired peak values of DC dimming control corresponding to the dimming levels P3 and P4, and outputs the DC dimming signal S40 indicative of the desired peak value corresponding to the dimming level P3 and the DC dimming signal S50 (see FIG. 8) indicative of the desired peak value corresponding to the dimming level P4 to the first power supply 10 and the second power supply 11, respectively.

Figure 8:
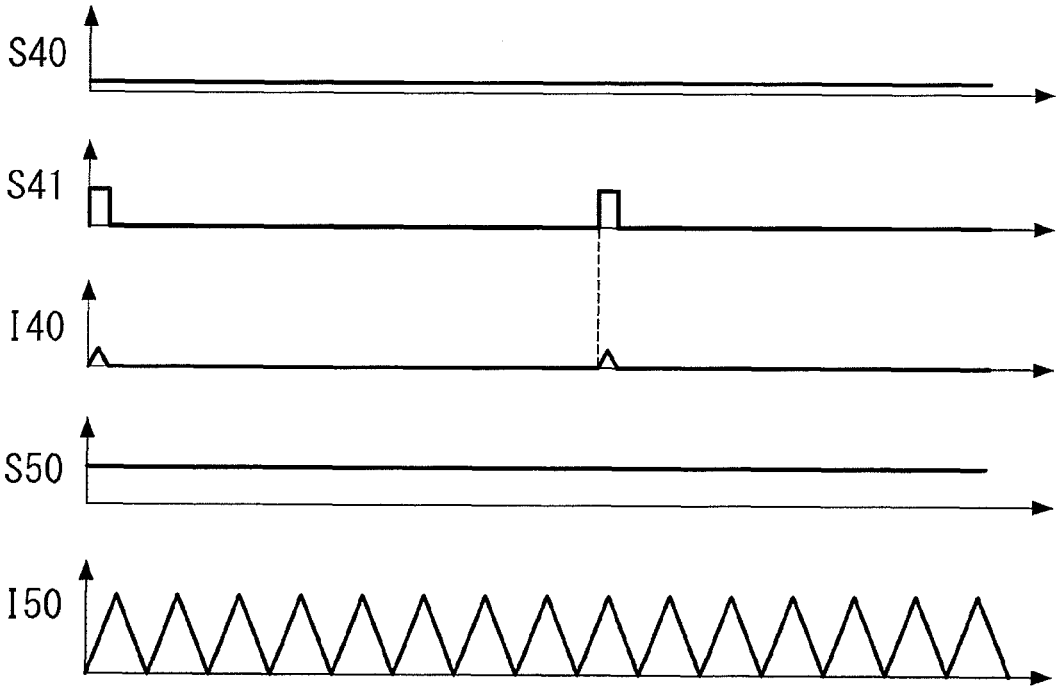
FIG. 8 is a time chart illustrating operation of the lighting control device of Embodiment 2.

The second chopper controller 111 of the second power supply 11 controls the switch device Q4 of the second step-down chopper circuit 110 in the critical current mode (see FIG. 8) based on the DC dimming signal S50 (see FIG. 8). Also in FIG. 8, 150 represents a current (inductor current) which flows through the inductor L21 of the second step-down chopper circuit 110.

While, the first chopper controller 101 of the first power supply 10 controls the switch device Q3 of the first step-down chopper circuit 100 in the discontinuous current mode (see FIG. 8) based on the DC dimming signal S40 (see FIG. 8) and the frequency signal S41. Also in FIG. 8, 140 represents a current (inductor current) which flows through the inductor L11 of the first step-down chopper circuit 100.

In more detail, the first chopper controller 101 is configured to turn on the switch device Q3 in synchronization with a rising edge of the frequency signal S41 (see FIG. 8), and turn off the switch device Q3 after a lapse of the on-period corresponding to the DC dimming signal S40 from the time of turning on the switch device Q3.

As a result, the color temperature of light which is a mixture of light from the first light source 2 lit by the first power supply 10 and light from the second light source 3 lit by the second power supply 11 is equal to the desired color temperature (2700 K) indicated by the color adjustment signal.

Note that, the dimming level P3 corresponds to the lower limit of the dimmable range of the first power supply 10, and is preferably equal to or less than 1%, for example. To achieve lighting at such an extremely low dimming level, the first chopper controller 101 performs dimming control on the first step-down chopper circuit 100 by use of a combination of the DC dimming manner and adjustment to the switching period in the discontinuous current mode.

As described above, in the lighting control device 1 and the lighting device 4 of the present embodiment, it is preferable that each of the first power supply 10 and the second power supply 11 be constituted by a step-down chopper circuit. Further, it is preferable that the first power supply 10 be configured to operate in the discontinuous current mode and the second power supply 11 be configured to operate in the critical current mode.

In summary, the first power supply 10 is configured to operate in the discontinuous current mode, and therefore the minimum value of electric power (corresponding to the lower limit of the dimming range) supplied from the first power supply 10 can be made to be lower than the minimum value of electric power supplied from the second power supply 11 configured to operate in the critical current mode.

Further, in the lighting control device 1 and the lighting device 4 of the present embodiment, the controller 12 does not perform dimming control on the first power supply 10 and the second power supply 11 in the burst dimming mode, and therefore a variation (ripple) in the output current can be suppressed. In other words, the first power supply 10 is configured to adjust the peak value of the current to be supplied to the first light source 2, and also the second power supply 11 is configured to adjust the peak value of the current to be supplied to the second light source 3. Consequently, it is possible to decrease the capacitances of the smoothing capacitors C3 and C4 provided to output sides of the first step-down chopper circuit 100 and the second step-down chopper circuit 110, and thus the lighting control device 1 and the lighting device 4 can be downsized.

Embodiment 3

Note that, each of a rated voltage of the first light source 2 and a rated voltage of the second light source 3 depends on types and the number of light emitting diodes to be used, and therefore the rated voltage of the first light source 2 is not equal to the rated voltage of the second light source 3 in some cases. If the first light source 2 and the second light source 3 have different rated voltages, there is no problem in a configuration where power is supplied from independent power supplies (the first power supply 10 and the second power supply 11) as with in a case of Embodiments 1 and 2. However, this configuration requires two power supplies, and may lead to increase in sizes of the lighting control device 1 and the lighting device 4.

In view of this, in the lighting device 4 including the lighting control device 1 of Embodiment 3 in accordance with the present invention, the first power supply 10 includes a constant current source, and a first switch device Q6 connected in series with the first light source 2 between output terminals of the constant current source. Further, the second power supply 11 includes the constant current source, and a second switch device Q7 connected in series with the second light source 3 between the output terminals of the constant current source. Moreover, the controller 12 is configured to turn on and off the first switch device Q6 and the second switch device Q7 alternately so that the color temperature of light which is a mixture of light from the first light source 2 and light from the second light source 3 is equal to the color temperature selected as a desired value.

Hereinafter, the lighting control device 1 and the lighting device 4 of the present embodiment are described in detail with reference to FIG. 9 to FIG. 13. Note that, the same components as Embodiments 1 and 2 are designated by the same reference signs as Embodiments 1 and 2 to avoid redundant description.

Figure 9:
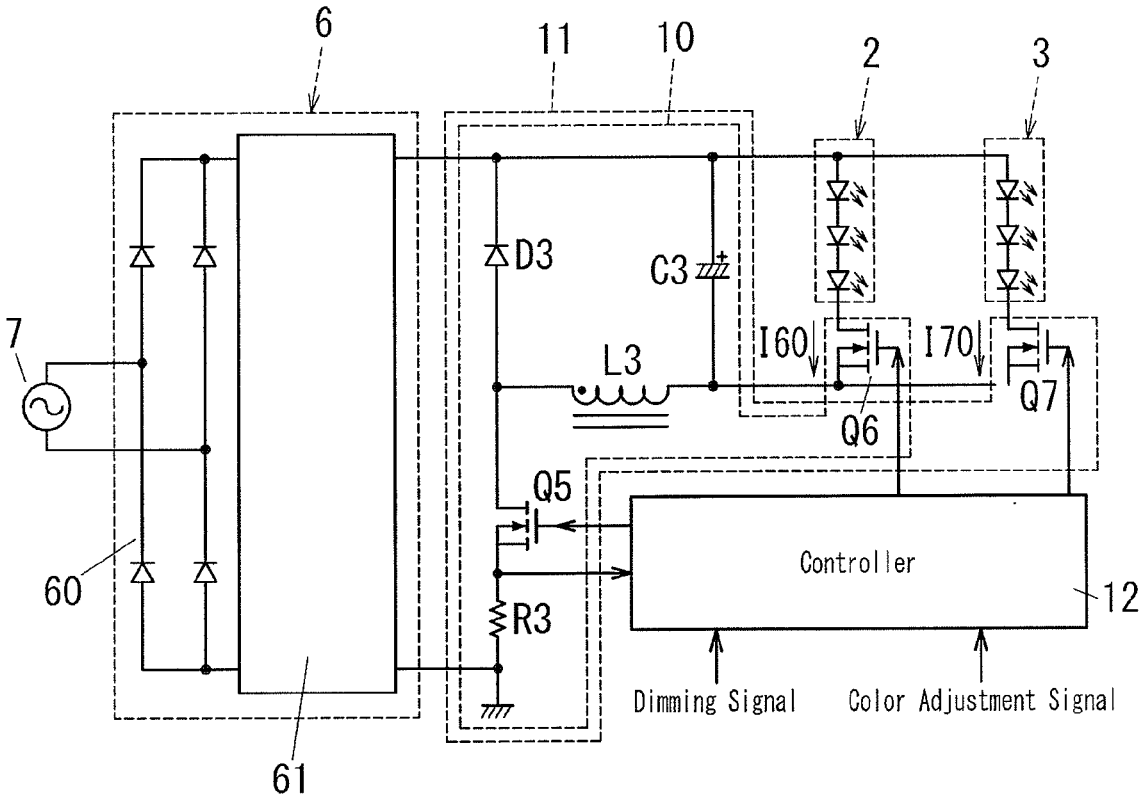
FIG. 9 is a diagram illustrating a configuration of a circuit of the lighting device including the lighting control device of Embodiment 3 in accordance with the present invention.

As shown FIG. 9, the DC power source 6 in the present embodiment is constituted by a diode bridge 60 for performing full-wave rectification on an AC voltage and an AC current of an AC power source 7, and an AC/DC converter 61 for converting a pulsating voltage and a pulsating current produced by full-wave rectification by the diode bridge 60 into a DC voltage and a DC current.

Further, the first power supply 10 of the present embodiment is constituted by the constant current source which is a step-down chopper circuit, and the first switch device Q6. The step-down chopper circuit has the almost same configuration as the first step-down chopper circuit 100 in Embodiment 1, and hence is constituted by a switch device Q5, a diode D3, an inductor L3, a capacitor C3, and a resistor R3, for example. The switch device Q5 is an n-channel type field-effect transistor. A drain of the switch device Q5 is connected to an anode of the diode D3, and a source of the switch device Q5 is connected to a negative electrode of the DC power source 6 via the resistor R3. The capacitor C3 is an electrolytic capacitor, and a higher potential side terminal thereof is connected to a cathode of the diode D3 and a positive electrode of the DC power source 6, and a lower potential side terminal thereof is connected to a first end of the inductor L3. A second end of the inductor L3 is connected to the anode of the diode D3. For examples, the both terminals of the capacitor C3 serve as output terminals of the constant current source.

The first switch device Q6 is an n-channel type field-effect transistor. A source of the first switch device Q6 is connected to the lower potential side terminal of the capacitor C3. The first light source 2 is connected between a drain of the first switch device Q6 and the higher potential side terminal of the capacitor C3.

The second power supply 11 is constituted by the constant current source (step-down chopper circuit) shared with the first power supply 10, and the second switch device Q7. The second switch device Q7 is an n-channel type field-effect transistor like the first switch device Q6. A source of the second switch device Q7 is connected to the lower potential side terminal of the capacitor C3. The second light source 3 is connected between a drain of the second switch device Q7 and the higher potential side terminal of the capacitor C3.

The controller 12 measures a drain current based on a voltage across the resistor R3, and adjusts a duty cycle of the switch device Q5 so that the drain current is equal to an intended value. Note that, the controller 12 determines the intended value of the drain current in accordance with a dimming level specified by a dimming signal given by an external device.

Further, the controller 12 is configured to adjust an on-period (first period T1) of the first switch device Q6 and an on-period (second period T2) of the second switch device Q7 in synchronization with a switching period T of the switch device Q5 of the constant current source, and turn on and off the two switch devices Q6 and Q7 alternately.

In other words, the controller 12 is configured to repeat a process of keeping the first switch device Q6 on and the second switch device Q7 off in the first period T1 of a predetermined period T1+T2 and of keeping the first switch device Q6 off and the second switch device Q7 on in the second period T2 which is a remaining period of the predetermined period T1+T2. The controller 12 is configured to adjust the color temperature of the light source by adjusting a ratio of the first period T1 to the second period T2.

Hereinafter, the operation of the lighting control device 1 is described with reference to FIG. 10 to FIG. 13. Each of FIG. 10 to FIG. 13 represents on and off states of the switch device Q5, on and off states of the first switch device Q6, a current I60 flowing through the first switch device Q6, on and off states of the second switch device Q7, and a current I70 flowing through the second switch device Q7.

Figure 10:
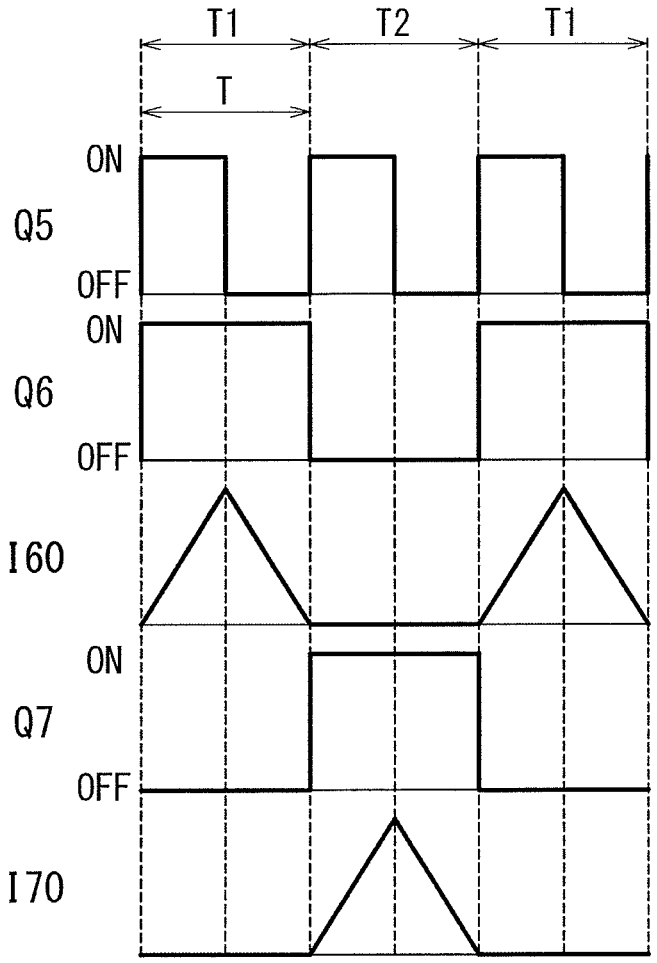
FIG. 10 is a time chart illustrating operation of the lighting control device of Embodiment 3.

For example, as shown in FIG. 10, the controller 12 turns on and off each of the switch devices Q6 and Q7 so that each of the on-period T1 of the first switch device Q6 and the on-period T2 of the second switch device Q7 is equal to the switching period T of the switch device Q5. In this case, a current flowing through the first light source 2 is equal to a current flowing through the second light source 3, and therefore the color temperature of light which is a mixture of light from the first light source 2 and light from the second light source 3 is about 4600 K.

Figure 11:
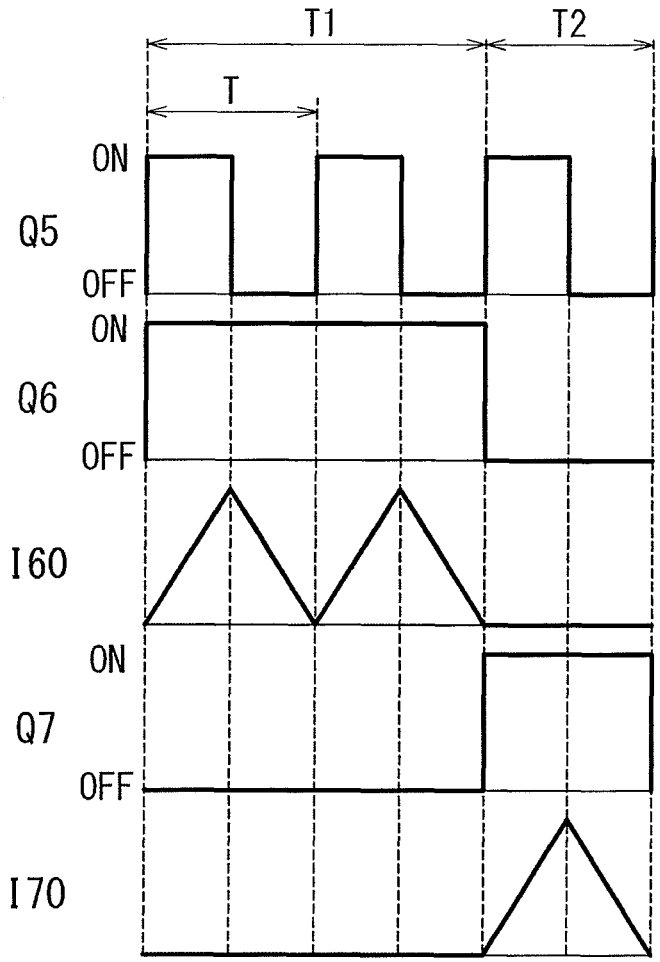
FIG. 11 is a time chart illustrating operation of the lighting control device of Embodiment 3.

In another case, as shown in FIG. 11, the controller 12 turns on and off each of the switch devices Q6 and Q7 so that the on-period T1 of the first switch device Q6 is equal to a double of the switching period T and the on-period T2 of the second switch device Q7 is equal to the switching period T. In this case, a ratio of the current flowing through the switch device Q6 to the current flowing through the switch device Q7 is 2:1, and therefore the color temperature of light which is a mixture of light from the first light source 2 and light from the second light source 3 is about 5200 K.

Figure 12:
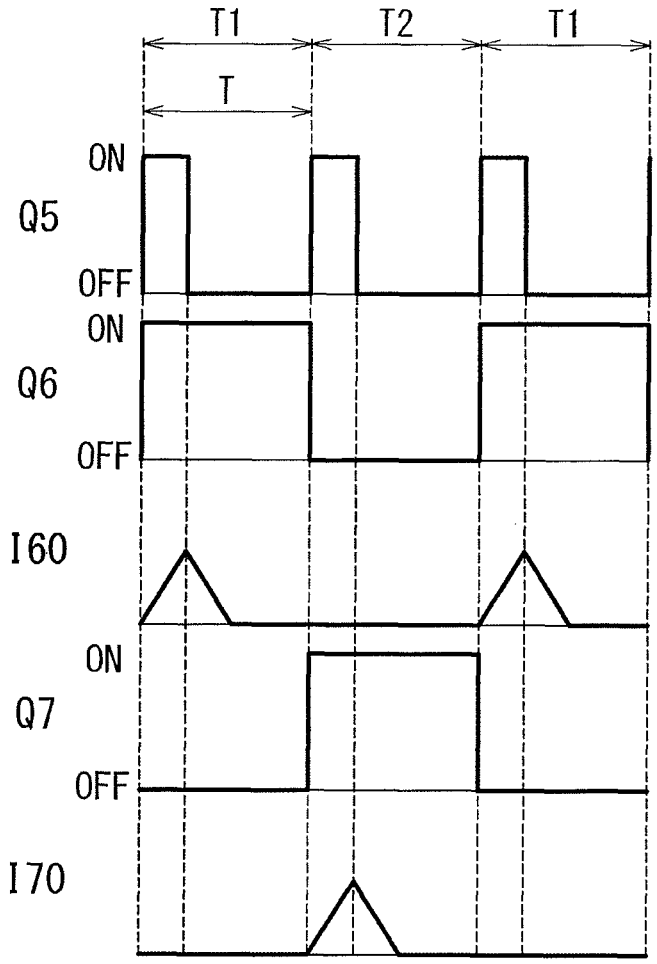
FIG. 12 is a time chart illustrating operation of the lighting control device of Embodiment 3.
Figure 13:
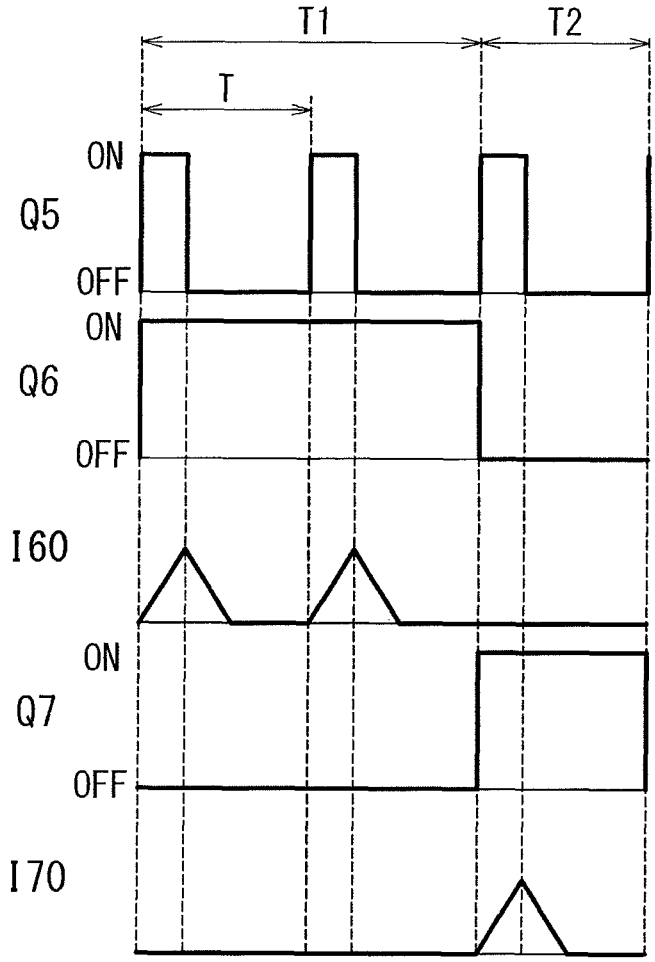
FIG. 13 is a time chart illustrating operation of the lighting control device of Embodiment 3.

Additionally, as shown in FIG. 12 and FIG. 13, if the controller 12 shortens the on-period of the switch device Q5 in accordance with the dimming signal, it is possible to change intensity (illuminance) without changing the color temperature of light which is a mixture of light from the first light source 2 and light from the second light source 3.

As described above, in the lighting control device 1 and the lighting device 4 of the present embodiment, the two power supplies 10 and 11 share the constant current source (step-down chopper circuit), and therefore a circuit configuration can be simplified and downsized relative to Embodiments 1 and 2.

Embodiment 4

Figure 14:
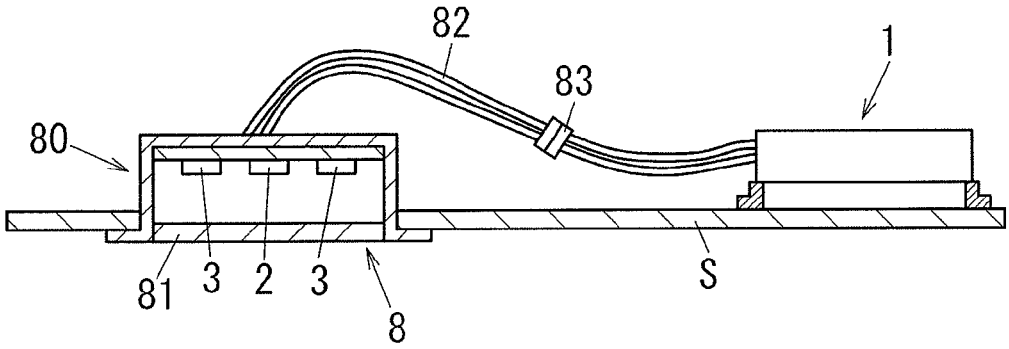
FIG. 14 is a section illustrating the lighting fixture of Embodiment 4 in accordance with the present invention.
Figure 15:
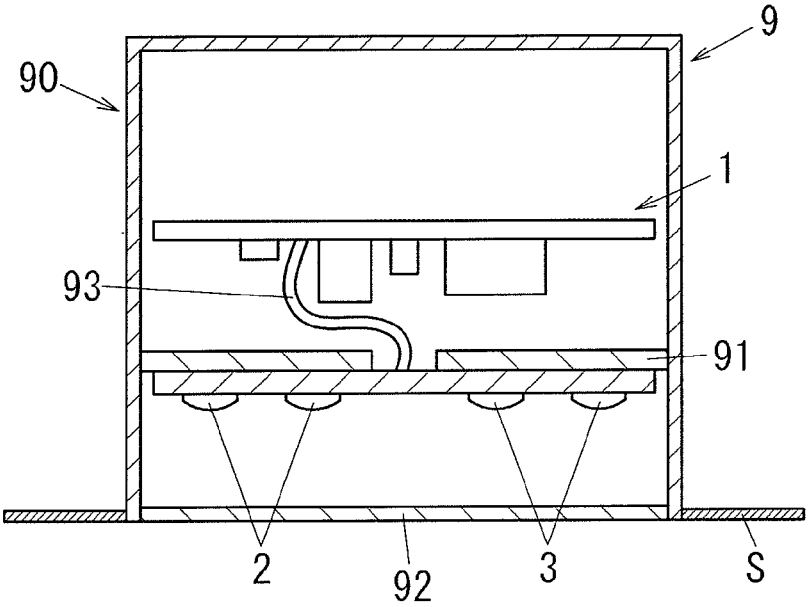
FIG. 15 is a section illustrating the lighting fixture of a modification of Embodiment 4 in accordance with the present invention.

FIG. 14 shows a lighting fixture 8 of Embodiment 4 in accordance with the present invention. Further, FIG. 15 shows a lighting fixture 9 of a modification of Embodiment 4 in accordance with the present invention.

The lighting fixture 8 shown in FIG. 14 is a downlight to be embedded in a ceiling S, and includes a fixture body 80 for accommodating the first light sources 2 and the second light sources 3, and the lighting control device 1 mounted on a rear side (upper side) of the ceiling S.

The fixture body 80 is in a hollow cylindrical shape with an open lower face and a closed bottom and is made of metal material such as aluminum die-casting product. The first light source 2 and the second light source 3 are attached to an inner bottom of the fixture body 80. The open lower face is closed by a cover 81 in a circular plate shape. Note that, the cover 81 is made of light transmissive material such as glass and polycarbonate.

The lighting control device 1 of the present embodiment may be any one of Embodiments 1 to 3. The lighting control device 1 is accommodated in a metal case in a rectangular box shape. Further, the lighting control device 1 is connected to the first light sources 2 and the second light sources 3 in the fixture body 80 via a power supply cable 82 and a connector 83.

The lighting fixture 9 shown in FIG. 15 is a downlight to be embedded in a ceiling S, and includes a fixture body 90 for accommodating the first light sources 2, the second light sources 3, and the lighting control device 1.

The fixture body 90 is in a hollow cylindrical shape with an open lower face and a closed bottom and is made of metal material such as aluminum die-casting product. An inside space of the fixture body 90 is divided in an upward and downward direction with a partition plate 91 in a circular plate shape. The open lower face is closed by a cover 92 which is in a circular plate shape and is made of light transmissive material such as glass and polycarbonate.

The first light sources 2 and the second light sources 3 are arranged on a lower face of the partition plate 91. Further, the lighting control device 1 is placed in a space above the partition plate 91, and is connected to the first light sources 2 and the second light sources 3 via a power supply cable 93.

As described above, the lighting fixture 8 (or 9) of the present embodiment includes at least one first light source 2, at least one second light source 3, the lighting control device 1, and the fixture body 80 (or 90) for supporting at least the at least one first light source 2 and the at least one second light source 3.

The lighting fixtures 8 and 9 of the present embodiment are configured like above, and therefore it is possible to suppress a variation in the light output and nevertheless expand the color adjustment range in contrast to a case where the minimum value of electric power supplied from the first power supply 10 is equal to the minimum value of electric power supplied from the second power supply 11, or a case where the first power supply 10 and the second power supply 11 are the same in the dimming performance.

(Aspects in Accordance with the Present Invention)

As apparent from the aforementioned embodiments, the lighting control device (1) of the first aspect in accordance with the present invention includes: a first power supply (10) configured to operate a first light source (2) for producing light with a relatively high color temperature; a second power supply (11) configured to operate a second light source (3) for producing light with a color temperature lower than the color temperature of light produced by the first light source (2); and a controller (12) configured to control the first power supply (10) and the second power supply (11). The first power supply (10) is configured to be controlled by the controller (12) so as to increase and decrease electric power to be supplied to the first light source (2). The second power supply (11) is configured to be controlled by the controller (12) so as to increase and decrease electric power to be supplied to the second light source (3). The controller (12) is configured to control the first power supply (10) and the second power supply (11) so that a color temperature of light which is a mixture of light from the first light source (2) and light from the second light source (3) is equal to a color temperature selected as a desired value. The first power supply (10) is configured such that a minimum value of electric power supplied from the first power supply (10) is lower than a minimum value of electric power supplied from the second power supply (11).

In other words, the lighting control device (1) of the first aspect includes: a power supply configured to operate a light source including a first light source (2) and a second light source (3) lower in color temperature than the first light source (2); and a controller (12) configured to control the power supply. The power supply includes: a first power supply (10) configured to supply electric power in a first range to the first light source (2); and a second power supply (11) configured to supply electric power in a second range to the second light source (3). The controller (12) is configured to control the first power supply (10) and the second power supply (11) to adjust the electric power supplied to the first light source (2) and the electric power supplied to the second light source (3) so that a color temperature of the light source is equal to a color temperature which is selected from a predetermined color adjustment range as a desired value. The first range is lower in a lower limit than the second range.

Further, the lighting control device (1) of the second aspect in accordance with the present invention includes: a first power supply (10) configured to operate a first light source (2) for producing light with a relatively high color temperature; a second power supply (11) configured to operate a second light source (3) for producing light with a relatively low color temperature; and a controller (12) configured to control the first power supply (10) and the second power supply (11). The first power supply (10) is configured to be controlled by the controller (12) so as to increase and decrease electric power to be supplied to the first light source (2). The second power supply (11) is configured to be controlled by the controller (12) so as to increase and decrease electric power to be supplied to the second light source (3). The controller (12) is configured to control the first power supply (10) and the second power supply (11) so that a color temperature of light which is a mixture of light from the first light source (2) and light from the second light source (3) is equal to a color temperature selected as a desired value. The first power supply (10) is configured to be higher in dimming performance than the second power supply (11).

In other words, the lighting control device (1) of the second aspect includes: a power supply configured to operate a light source including a first light source (2) and a second light source (3) lower in color temperature than the first light source (2); and a controller (12) configured to control the power supply. The power supply includes: a first power supply (10) configured to adjust a light output of the first light source (2) in a first range; and a second power supply (11) configured to adjust a light output of the second light source (3) in a second range. The controller (12) is configured to control the first power supply (10) and the second power supply (11) to adjust the light output of the first light source (2) and the light output of the second light source (3) so that a color temperature of the light source is equal to a color temperature which is selected from a predetermined color adjustment range as a desired value. The first range is lower in a lower limit than the second range.

The lighting control device (1) of the third aspect in accordance with the present invention is realized in combination with the first or second aspect. In the lighting control device (1) of the third aspect, the controller (12) is configured to control the second power supply (11) so as to adjust a peak value of a current to be supplied to the second light source (3), and is configured to control the first power supply (10) so as to adjust a peak value of a current to be supplied to the first light source (2) and a period in which a current is intermittently supplied to the first light source (2).

In the other words, in the lighting control device (1) of the third aspect, the first power supply (10) is configured to perform peak value adjusting control of adjusting a peak value of a current supplied to the first light source (2) and duty cycle adjusting control of adjusting a duty cycle of the current. The second power supply (11) is configured to adjust a peak value of a current supplied to the second light source (3).

The lighting control device (1) of the fourth aspect in accordance with the present invention is realized in combination with the third aspect. In the lighting control device (1) of the fourth aspect, the first range includes a first section between an upper limit of the first range and a predetermined value which is smaller than the upper limit but larger than the lower limit of the first range, and a second section between the predetermined value and a lower limit of the first range. The controller (12) is configured to cause the first power supply (10) to perform either the peak value adjusting control or the duty cycle adjusting control in the first section. The controller (12) is configured to cause the first power supply (10) to perform both the peak value adjusting control and the duty cycle adjusting control in the second section.

The lighting control device (1) of the fifth aspect in accordance with the present invention is realized in combination with the first or second aspect. In the lighting control device (1) of the fifth aspect, each of the first power supply (10) and the second power supply (11) is constituted by a step-down chopper circuit (100, 110). The first power supply (10) is configured to operate in a discontinuous current mode. The second power supply (11) is configured to operate in a critical current mode.

In the other words, in the lighting control device (1) of the fifth aspect, the first power supply (10) is a step-down chopper circuit (100) configured to operate in a discontinuous current mode, and the second power supply (11) is a step-down chopper circuit (110) configured to operate in a critical current mode.

The lighting control device (1) of the sixth aspect in accordance with the present invention is realized in combination with the first or second aspect. In the lighting control device (1) of the sixth aspect, the first power supply (10) includes a constant current source, and a first switch device (Q6) connected in series with the first light source (2) between output terminals of the constant current source. The second power supply (11) includes the constant current source, and a second switch device (Q7) connected in series with the second light source (3) between the output terminals of the constant current source. The controller (12) is configured to turn on and off the first switch device (Q6) and the second switch device (Q7) alternately so that the color temperature of light which is a mixture of light from the first light source (2) and light from the second light source (3) is equal to the color temperature selected as the desired value.

In the other words, in the lighting control device (1) of the sixth aspect, the first power supply (10) includes a constant current source, and a first switch device (Q6) connected in series with the first light source (2) between output terminals of the constant current source. The second power supply (11) includes the constant current source, and a second switch device (Q7) connected in series with the second light source (3) between the output terminals of the constant current source. The controller (12) is configured to repeat a process of keeping the first switch device (Q6) on and the second switch device (Q7) off in a first period (T1) of a predetermined period (T1+T2) and of keeping the first switch device (Q6) off and the second switch device (Q7) on in a second period (T2) which is a remaining period of the predetermined period (T1+T2). The controller (12) is configured to adjust the color temperature of the light source by adjusting a ratio of the first period (T1) to the second period (T2).

The lighting control device (1) of the seventh aspect in accordance with the present invention is realized in combination with any one of the first to sixth aspects. In the lighting control device (1) of the seventh aspect, the first range is wider than the second range.

The lighting control device (1) of the eighth aspect in accordance with the present invention is realized in combination with any one of the first to seventh aspects. In the lighting control device (1) of the eighth aspect, the first light source (2) has a color temperature higher than an upper limit of the predetermined color adjustment range, and the second light source (3) has a color temperature equal to a lower limit of the predetermined color adjustment range.

The lighting control device (1) of the ninth aspect in accordance with the present invention is realized in combination with the eighth aspect. In the lighting control device (1) of the ninth aspect, the upper limit of the predetermined color adjustment range is 5000 K. The lower limit of the predetermined color adjustment range is 2700 K. The color temperature of the first light source (2) is 6500 K.

The lighting device (4) of the tenth aspect in accordance with the present invention includes: the first light source (2); the second light source (3); and the lighting control device (1) of any one of the first to ninth aspects.

In other words, the lighting device (4) of the tenth aspect includes: a light source including a first light source (2) and a second light source (3) lower in color temperature than the first light source (2); and the lighting control device (1) according to any one of the first to ninth aspects.

The lighting fixture (8, 9) of the eleventh aspect in accordance with the present invention includes: the first light source (2); the second light source (3); the lighting control device (1) of any one of the first to ninth aspects; and a fixture body (80, 90) for supporting at least the first light source (2) and the second light source (3).

In other words, the lighting fixture (8, 9) of the eleventh aspect includes: a light source including a first light source (2) and a second light source (3) lower in color temperature than the first light source (2); the lighting control device (1) according to any one of the first to ninth aspects; and a fixture body (80, 90) for supporting the light source.

As described above, the lighting control device (1), the lighting device (4), and the lighting fixture (8, 9) of the aspects in accordance with the present invention offer advantageous effects that it is possible to suppress a variation in the light output and nevertheless expand the color adjustment range.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting control device, comprising:

a power supply configured to operate a light source including a first light source and a second light source lower in color temperature than the first light source; and a controller configured to control the power supply, the power supply including:

a first power supply configured to supply electric power to the first light source from a first high power level (P1) corresponding to a high color temperature of the light source to a first low power level (P3) corresponding to a low color temperature of the light source; and a second power supply configured to supply electric power to the second light source from a second low power level (P2) corresponding to the high color temperature of the light source to a second high power level (P4) corresponding to the low color temperature of the light source, the controller being configured to control the first power supply and the second power supply to adjust the electric power supplied to the first light source and the electric power supplied to the second light source so that a color temperature of the light source is equal to a color temperature which is selected from a predetermined color adjustment range as a desired value, and the first low power level (P3) is lower than the second low power level (P2).

2. A lighting control device, comprising:

a power supply configured to operate a light source including a first light source and a second light source lower in color temperature than the first light source; and a controller configured to control the power supply, the power supply including:

a first power supply configured to adjust a light output of the first light source from a high dimming level (P1) of the first light source corresponding to an upper color temperature of the light source to a low dimming level (P3) of the first light source corresponding to a lower color temperature of the light source; and a second power supply configured to adjust a light output of the second light source from a low dimming level (P2) of the second light source corresponding to the upper color temperature of the light source to a high dimming level (P4) of the second light source corresponding to the lower color temperature of the light source, the controller being configured to control the first power supply and the second power supply to adjust the light output of the first light source and the light output of the second light source so that a color temperature of the light source is equal to a color temperature which is selected from a predetermined color adjustment range as a desired value, and the low dimming level (P3) of the first light source is lower than the low dimming level (P2) of the second light source.

3. The lighting control device according to claim 1, wherein:

the first power supply is configured to perform peak value adjusting control of adjusting a peak value of a current supplied to the first light source and duty cycle adjusting control of adjusting a duty cycle of the current; and the second power supply is configured to adjust a peak value of a current supplied to the second light source.

4. The lighting control device according to claim 3, wherein:

a power range from the first high power level (P1) to the first low power level (P3) is a first power range and the first power range includes:

a first power section between an upper limit of the first power range and a predetermined value which is smaller than the upper limit but larger than a lower limit of the first power range, and a second power section between the predetermined value and the lower limit of the first power range;

the controller is configured to cause the first power supply to perform either the peak value adjusting control or the duty cycle adjusting control in the first power section; and the controller is configured to cause the first power supply to perform both the peak value adjusting control and the duty cycle adjusting control in the second power section.

5. The lighting control device according to claim 1, wherein:

the first power supply is a step-down chopper circuit configured to operate in a discontinuous current mode; and the second power supply is a step-down chopper circuit configured to operate in a critical current mode.

6. The lighting control device according to claim 1, wherein a power range from the second high power level (P4) to the first low power level (P3) is a power range of the first light source, a power range from the second low power level (P2) to the second high power level (P4) is a power range of the second light source, and the power range of the first light source is wider than the power range of the second light source.

7. The lighting control device according to claim 1, wherein:

the first light source has a color temperature higher than an upper limit of the predetermined color adjustment range; and the second light source has a color temperature equal to a lower limit of the predetermined color adjustment range.

8. The lighting control device according to claim 7, wherein:

the upper limit of the predetermined color adjustment range is 5000 K;

the lower limit of the predetermined color adjustment range is 2700 K; and the color temperature of the first light source is 6500 K.

9. A lighting device, comprising:

a light source including a first light source and a second light source lower in color temperature than the first light source; and the lighting control device according to claim 1.

10. The lighting control device according to claim 2, wherein:

the first power supply is configured to perform peak value adjusting control of adjusting a peak value of a current supplied to the first light source and duty cycle adjusting control of adjusting a duty cycle of the current; and the second power supply is configured to adjust a peak value of a current supplied to the second light source.

11. The lighting control device according to claim 10, wherein:

a dimming range from the high dimming level (P1) of the first light source to the low dimming level (P3) of the first light source is a first dimming range and the first dimming range includes a first dimming section between an upper limit of the first dimming range and a predetermined value which is smaller than the upper limit but larger than a lower limit of the first dimming range, and a second dimming section between the predetermined value and the lower limit of the first dimming range;

the controller is configured to cause the first power supply to perform either the peak value adjusting control or the duty cycle adjusting control in the first dimming section; and the controller is configured to cause the first power supply to perform both the peak value adjusting control and the duty cycle adjusting control in the second dimming section.

12. The lighting control device according to claim 2, wherein:

the first power supply is a step-down chopper circuit configured to operate in a discontinuous current mode; and the second power supply is a step-down chopper circuit configured to operate in a critical current mode.

13. The lighting control device according to claim 2, wherein a dimming range from the high dimming level (P4) of the second light source to the low dimming level (P3) of the first light source is a dimming range of the first light source, a dimming range from the low dimming level (P2) of the second light source to the high dimming level (P4) of the second light source is a dimming range of the second light source, and the dimming range of the first light source is wider than the dimming range of the second light source.

14. The lighting control device according to claim 2, wherein:

the first light source has a color temperature higher than an upper limit of the predetermined color adjustment range; and the second light source has a color temperature equal to a lower limit of the predetermined color adjustment range.

15. The lighting control device according to claim 14, wherein:

the upper limit of the predetermined color adjustment range is 5000 K;

the lower limit of the predetermined color adjustment range is 2700 K; and the color temperature of the first light source is 6500 K.

16. A lighting device, comprising:

a light source including a first light source and a second light source lower in color temperature than the first light source; and the lighting control device according to claim 2.

* * * * *